US006131940A

United States Patent [19]

Arnoth

[11] Patent Number: 6,131,940

[45] **Date of Patent: *Oct. 17, 2000**

[54] TILT-IN-SPACE WHEELCHAIR

[76] Inventor: Frank W. Arnoth, 20 Concord Creek Rd., Glen Mills, Pa. 19342

[ * ] Notice: This patent is subject to a terminal disclaimer.

[21] Appl. No.: 09/096,392

[22] Filed: Jun. 11, 1998

[51] Int. Cl.[7] ..... A61G 5/02

[52] U.S. Cl. ..... 280/650; 280/250.1; 280/47.4; 297/39

[58] Field of Search ..... 280/650, 657, 280/250.1, 47.4; 297/39; 403/322.1

[56] References Cited

U.S. PATENT DOCUMENTS

| | | | |
|---|---|---|---|
| 4,527,944 | 7/1985 | Qually et al. . | |
| 4,565,385 | 1/1986 | Morford . | |
| 4,592,570 | 6/1986 | Nassiri . | |
| 4,759,561 | 7/1988 | Janssen . | |
| 4,840,390 | 6/1989 | Lockard et al. | 280/250.1 |
| 4,968,050 | 11/1990 | Kendrick et al. | 280/250.1 |
| 5,028,061 | 7/1991 | Hawkes | 280/47.1 |
| 5,044,647 | 9/1991 | Patterson . | |
| 5,154,438 | 10/1992 | Barclay . | |
| 5,292,144 | 3/1994 | Sosnoff . | |
| 5,294,141 | 3/1994 | Mentessi et al. . | |
| 5,297,021 | 3/1994 | Koerlin et al. . | |
| 5,827,005 | 10/1998 | Liu | 403/322.1 |
| 5,855,387 | 1/1999 | Gill et al. | 280/250.1 |
| 5,957,474 | 9/1999 | Mundy et al. | 280/250.1 |

OTHER PUBLICATIONS

Catalog, "Action Tiger", Action Technology, 39350 Taylor Parkway, North Ridgeville, OH 44039, Form No. 93–06 (1 Sheet, 2 Pages).

Catalog, "Zippie Series", Quickie Designs, Inc., 2842 Business Park Avenue, Fresno, CA 93727–1328, #932001, (c) 1996, (8 Pages).

Catalog, "Quickie Positioning Products", Quickie Designs, Inc. –supra–, Revision 2–96(1 Sheet, 2 Pages).

Magazine, the Wheelchair, a Supplement to Homecare(R), May 1991, pub. Homecare(R), P.O. Box 16448, N. Hollywood, CA 91615–6448 (64 Pages).

*Primary Examiner*—Michael Mar
*Assistant Examiner*—Hau Phan
*Attorney, Agent, or Firm*—Edward J. Kaliski

[57] ABSTRACT

A structure for a collapsible wheelchair is provided in which the casters are each mounted on a four bar linkage pivoted from a cam actuated rotary lock mechanism on the frame of the chair.

4 Claims, 6 Drawing Sheets

TILT-IN-SPACE WHEELCHAIR

FIELD OF THE INVENTION

This invention relates to the field of wheelchairs, particularly to so call "tilt-in-space" wheelchairs, and more particularly to collapsible tilt-in-space wheel chairs.

BACKGROUND OF THE INVENTION

A significant population of all ages is confined to move in a wheelchair all or part of the time and these people face many challenges. While some of their problems are solved by the limited mobility afforded them through the wheelchair, other problems stem from the design of the chairs.

There are, at present, two major categories of wheelchairs: collapsible wheelchairs, which have fabric seats and backs and which can be collapsed sideways to make them easily transportable; and rigid wheelchairs which cannot be collapsed. The collapsible chairs are lightweight, relatively inexpensive, and transportable in the trunk or back seat of a car. Rigid frame wheelchairs, on the other hand, are relatively expensive and usually require a van or other specially prepared vehicle for transport.

For many patients it is desirable to have a chair which allows the position of the seat to be changed from the normal, level, position to one which is tilted back. Among other benefits this change in position changes the pressure distribution of the patient's body against the chair improving comfort. In the trade, this type of chair is known as a "tilt-in-space wheelchair". This feature is available only in wheelchairs having rigid frames. A patient is forced to choose between the lower cost and easy portability of a folding chair and the comfort, increased cost and inconvenience of a tilt-in-space wheelchair.

It is, therefore, an object of this invention to provide a tilt-in-space feature adaptable to a collapsible wheelchair. It is an object that the mechanism provided have sufficient lateral stiffness on each side of the wheelchair to obviate the need for cross bracing such as is found on rigid frame chairs.

Further, tilting a wheel chair could be accomplished by extending the length of the support means connecting the casters to the frame. This changes the angle which the caster assembly, particularly the vertical axis of rotation (ie. the swivel post) presents to the ground. However, the greater this angle varies from vertical, the poorer the performance of the caster. It is, therefore, an object of this invention to provide means of tilting a wheelchair without varying the vertical axis about which the caster assembly rotates.

BRIEF SUMMARY OF THE INVENTION

The instant invention meets this object with a device which allows the casters of a collapsible wheel to be repositioned vertically relative to the frame of the chair. The casters are moved to a position lower than normal with the effect of tilting the frame in the opposite direction. However when so repositioning the casters, it is important to ensure that the swivel post of the caster remains substantially perpendicular to the ground in order for the caster wheel to swivel smoothly and operate properly. By using a four bar linkage incorporating the caster mounting plate and a mounting plate connected to, or part of, the frame of the wheelchair as two parts of the linkage connected by arms to control the attitude of the caster plate relative the ground, in combination with a selectively actuated, rotational-lock located in the frame or mounting plate link to securely fix the angular position of the main indexing (linkage) arm in a variety of positions, this tilt-in-space feature can be added to a collapsible wheelchair because a linkage of this type presents adequate lateral stiffness. The four bar linkage is proportioned so that when installed on a wheelchair, the structure may be tilted while the swivel posts of the casters remain substantially vertical. Adapting a four bar linkage to trace a desired path in space is well known to those of skill in the art. This use of a selectively angled linkage provides the physiological benefits of tilting to collapsible wheelchairs where previously the lack of a rigid frame prevented installation of a tilting mechanism.

A preferred cam actuated rotational gear lock is used to maintain the angle selected. This mechanism, including combination with a four bar linkage, is the subject of patent application filed of even date with this application, "Cam Actuated Rotational Gear Lock" [AR1], the disclosure of which is incorporated herein by reference.

This rotational lock preferred is an indexable arm keyed to a shaft rotationaly extending through a mounting plate fixed to the frame of the chair. A hollow cylindrical, radial-surface stationary cam is concentric with a bushing concentric with a clutch base. These are fixed to the mounting plate concentric with the shaft. The clutch base is a hollow cylindrical, radial gear. The gear teeth have sharp arrises. A matching gear/clutch half, is slideable on the shaft but fixed against rotation relative to the shaft and is compression-spring loaded. The spring is concentric with the shaft and thrusts against a washer fixed to the end of the shaft. As a result, the gear/clutch is normally engaged with the clutch base. An actuating, moveable cam is rotatably mounted on the periphery of the bushing and slideable with it being held in place by a throw-out plate fastened to the moveable gear/clutch half. When the cam actuating arm rotates the moveable cam the interaction between the moving and the fixed cam halves slidingly forces the cam half against the throwout plate forcing the moveable gear/clutch half to slide out of engagement. The spring is compressed against the washer. The indexing arm, now unlocked, may be rotated to a desired position. When the turning force on the cam is released, the compression spring forces the assembly closed locking the indexing arm in place.

DETAILED DESCRIPTION OF THE INVENTION

Figure 1:
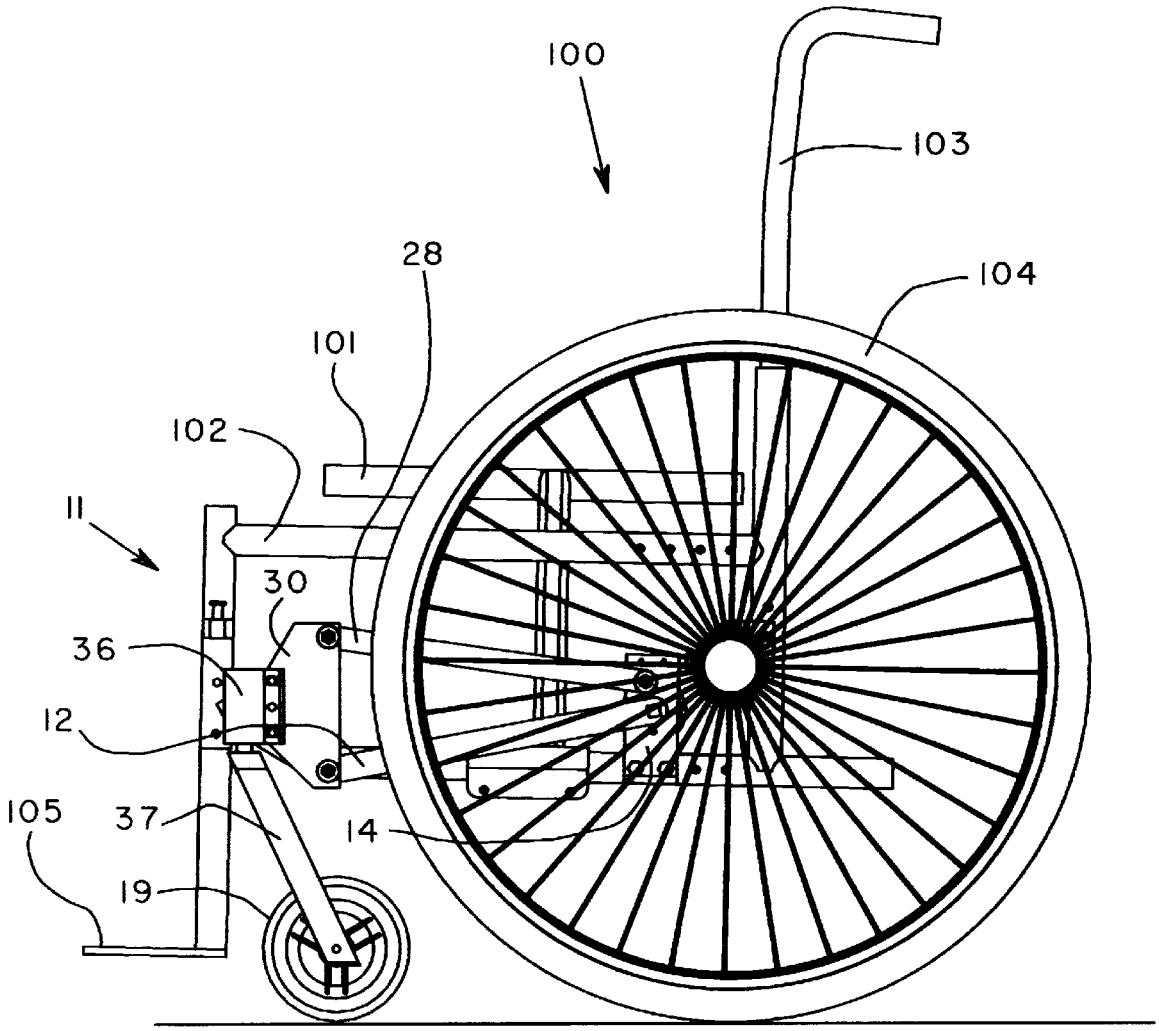
FIG. 1 is an elevational view of a tilt-in-space wheelchair incorporating the four bar linkage and rotational-lock mechanism of the invention shown in the untilted position.
Figure 2:
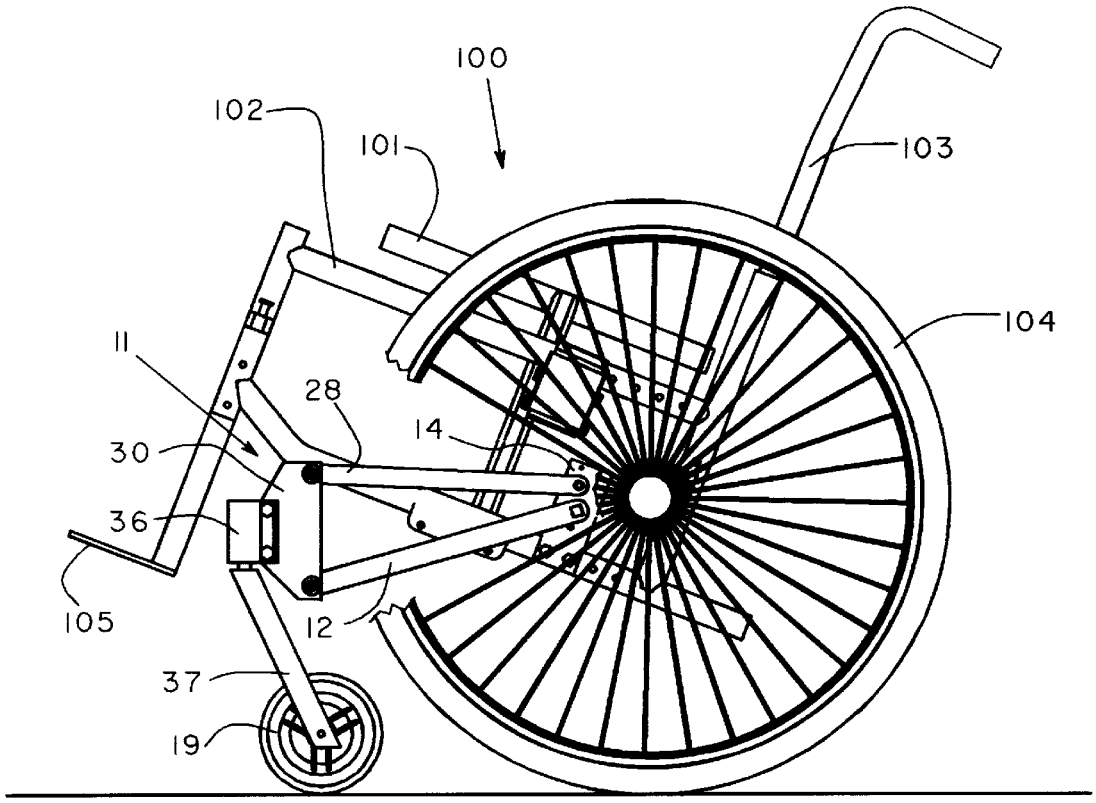
FIG. 2 is an elevational view of the tilt-in-space wheelchair of FIG. 1 in a tilted position with part of the wheel broken away for clarity.

The wheelchair of the invention is shown in FIGS. 1 and 2, untilted and tilted. The angle through which the chair can be adjusted in finite steps is about forty five degrees.

Refer to FIGS. 1 and 2. Wheel chair 100 is comprised of frame 102, seat support 101 mounted on frame 102, back

103 which is part of frame 102, operating wheels 104 rotationally mounted on opposed sides of frame 102 and foot rest 105 which may be dismountably connected to frame 102. The drawing actually omits the body supporting part of seat 101 which is a canvas sling extending from one seat support 101 on one side of frame 102 to the other seat support 101 on the other side of frame 102. Casters 37 having wheels 19 at one end and swivel post 36 each comprising a post swivelly mounted to a sleeve at the other are attached to plate 30 which is part of a four bar linkage 11. The other bars are arms 28 and 12, the latter being an indexable arm, and plate 14 which is connected to frame 102 or which can be part of the frame itself. The four bars, by definition, are rotationaly connected.

Figure 3:
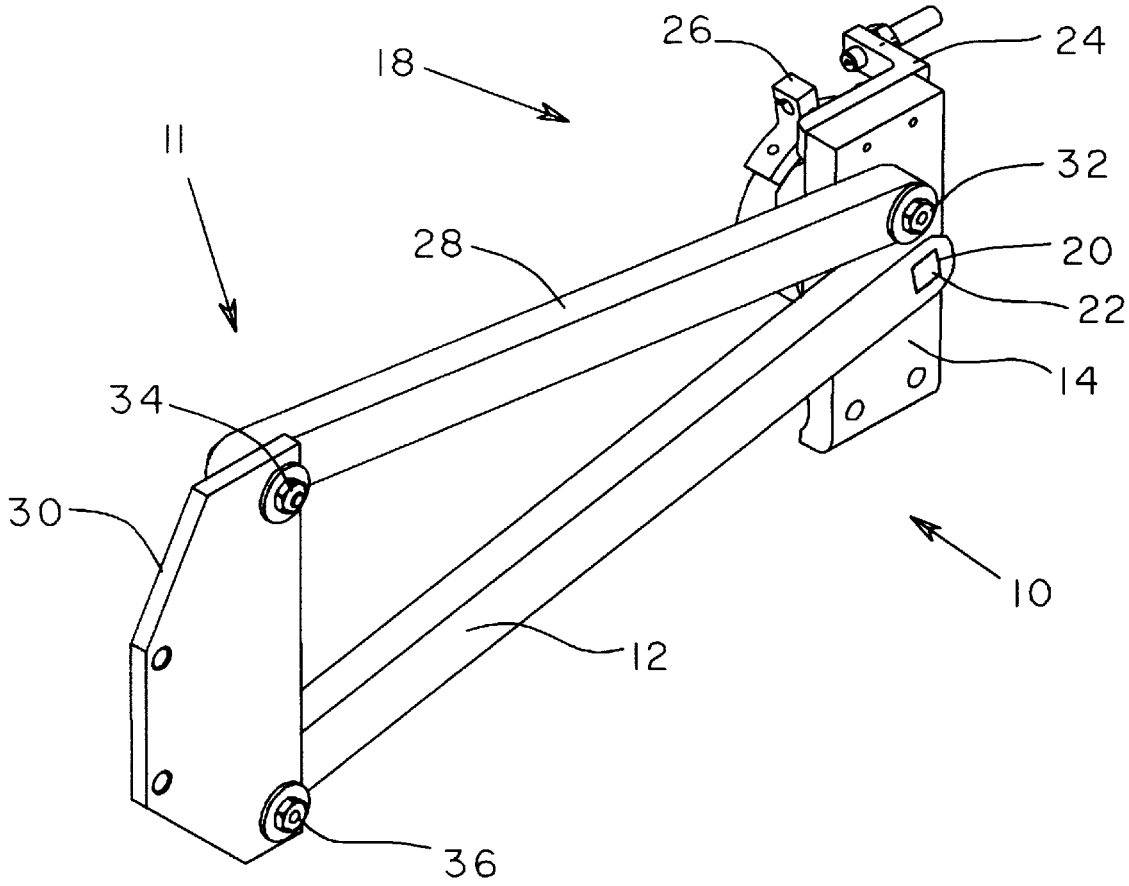
FIG. 3 is an isometric view of a rotational-lock mechanism and the four bar linkage shown fully assembled.
Figure 4:
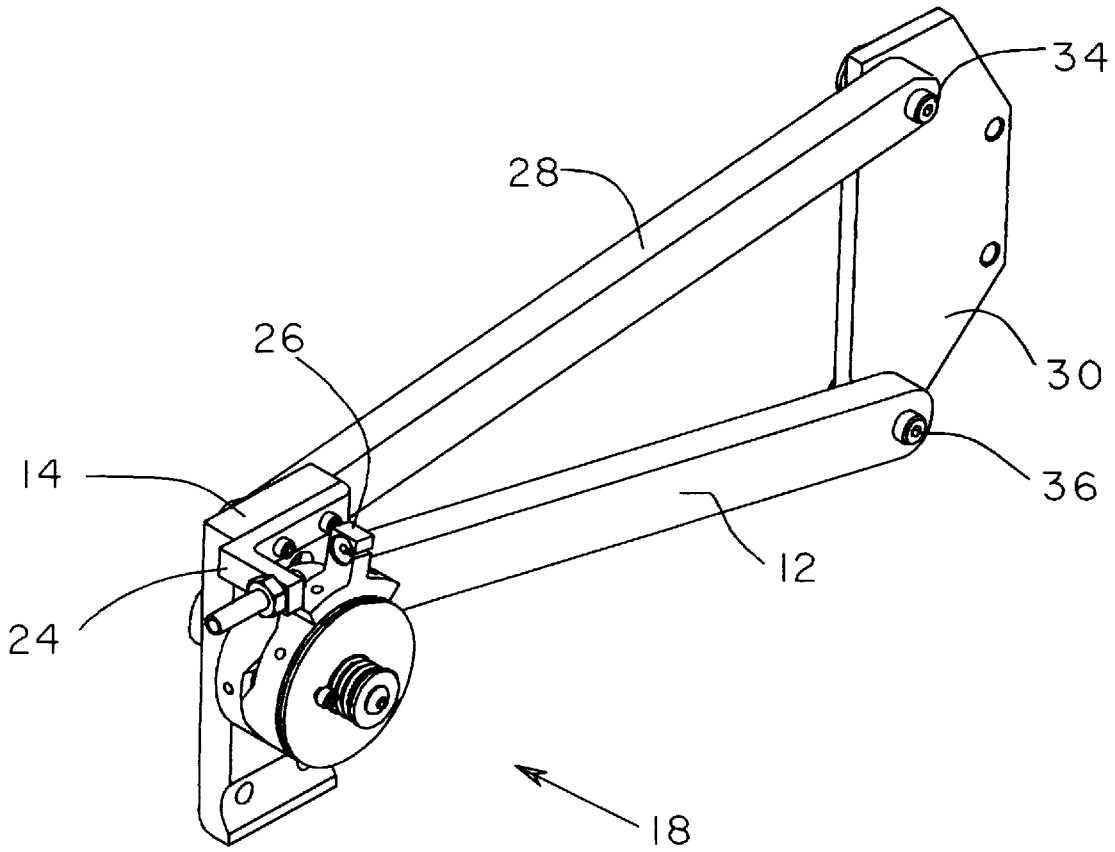
FIG. 4 is a view of the reverse side of the mechanism of FIG. 3.
Figure 5:
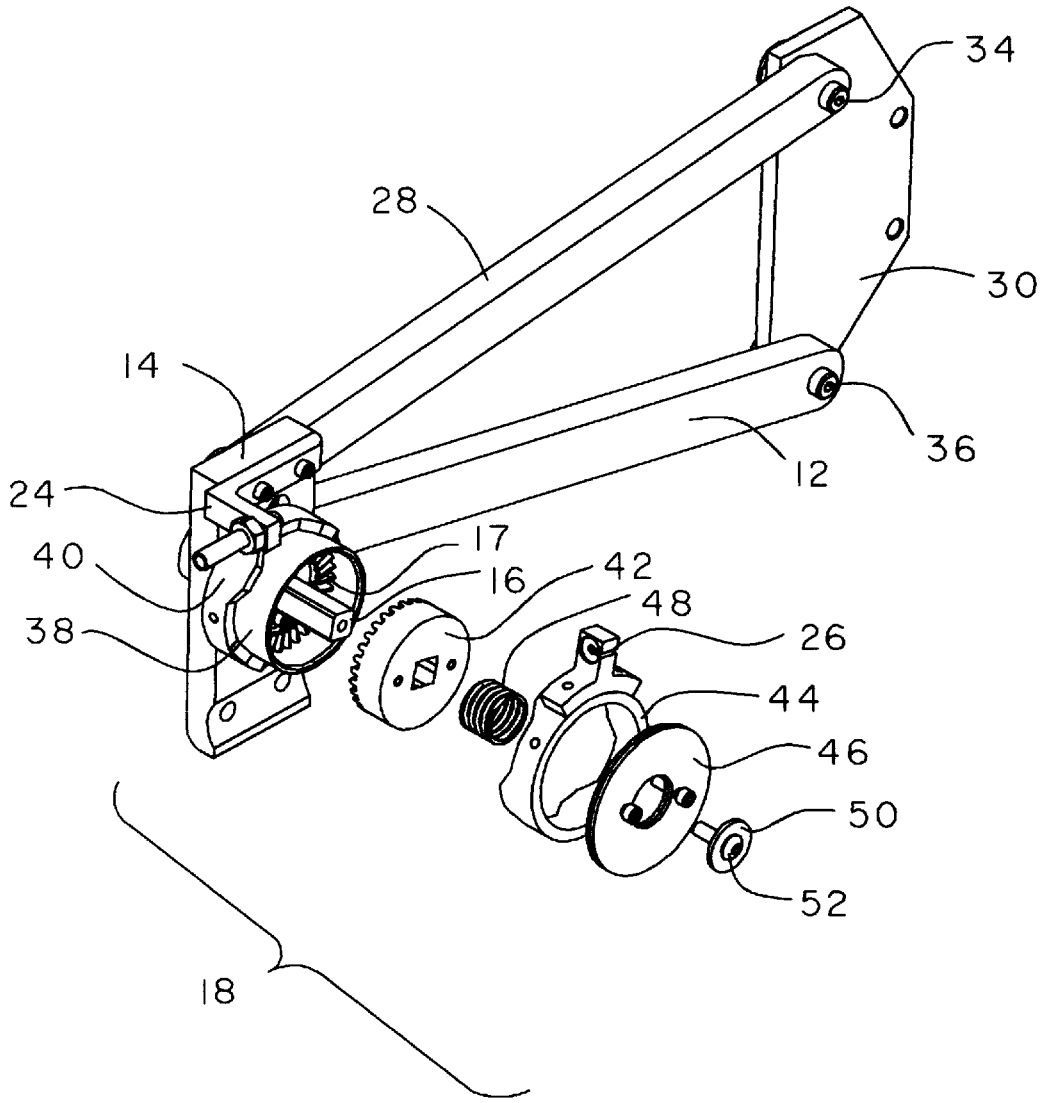
FIG. 5 is a partially exploded view of FIG. 4.

FIGS. 3, 4 and 5 show the mechanism 10 that provides the needed selective rotational lock 18. It comprises the indexable arm 12 pivotally mounted on plate 14 by being fixed to a shaft 16 which rotates within plate 14. Also shaft mounted is the gear lock assembly 18. It is preferred to attach arm 12 to shaft 16 by using a square shaft end 20 in a corresponding square hole 22 in arm 12. Plate 14 may be attached to frame 102 as in FIGS. 1 and 2, or the frame may substitute for it. Bracket 24 is fastened to plate 14 to anchor a flexible cable, not shown, which is connected to cam lever actuator 26 as will be described further. Such a cable is easily and conveniently pulled at will by the attendant of the occupant of the chair.

Figure 6:
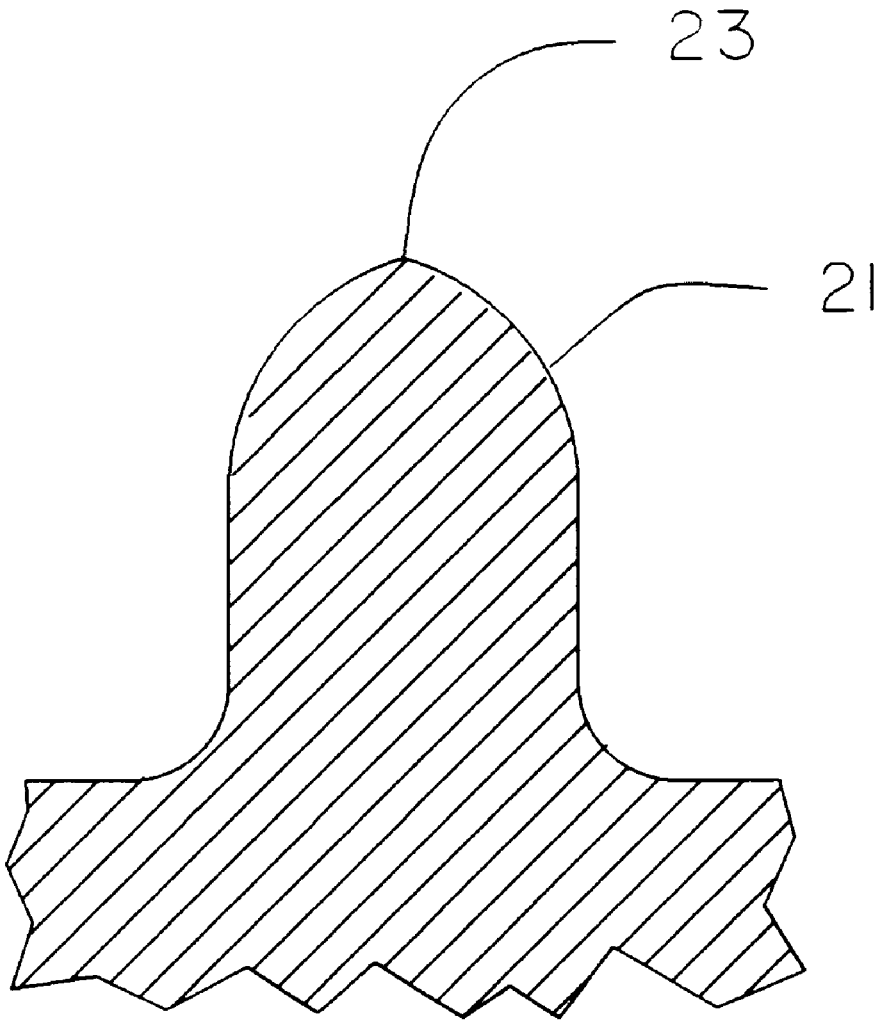
FIG. 6 is a cross-sectional view of a gear tooth used in the locking mechanism of FIGS. 3–5.

In use (best seen in FIG. 5), the cam actuating arm 26 is rotated manually (a cable actuator, not shown, is preferred). This turns the moveable cam 44 on bushing 38 and the interaction between the moving and the fixed cam halves (44,40) slidingly forces the cam half 44 against the throwout plate 46 forcing the moveable gear/clutch half 42, which is fastened to throwout plate 46 to slide out of engagement with the fixed gear/clutch half 17. The spring 48 is compressed against washer 50 which effectively is part of or fixed to shaft 16. The indexing arm 12, now unlocked, may be rotated to a desired position as by tilting the chair. When the turning force on cam 44 is released, compression spring 48 forces the gear/clutch halves (16,42) closed locking the indexing arm 12 in place. To facilitate easy meshing of the gear/clutch halves (17, 44), the teeth 21 are provided with sharp arrises as seen in FIG. 6. The mating gear surfaces contact at a locking angle. This locks arm 12 against rotation under the thrust of compression spring 48. The mating cam halves (40, 44) contact at a non-locking angle. Thus it is easy to rotate cam half 44 and easy for the cam half to slide outward to compress spring 48 and unlock arm 12. To insure a positive release it is preferred that the means to rotate cam 44 also be spring loaded towards the locked position as by a compression spring (not shown) in the preferred cable actuator (not shown).

To insure easy meshing of the gear/clutch halves, the teeth 21 are provided with sharp arrises 23 (see FIG. 6.). This tip form is a known expedient for making easily meshed gears. The mating gear surfaces contact at a locking angle. This locks arm 12 against rotation under the thrust of spring 48. The mating cam halves contact at a non-locking angle. Thus it is easy to rotate cam half 44 and easy for the cam half to slide outward to compress spring 48 and unlock arm 12 and easy for the cam half to slide inward as the mechanism locks under spring force. To insure a positive release it is preferred that the means to rotate cam 44 also be spring loaded towards the locked position as by a compression spring, not shown, in the preferred cable actuator, also not shown.

What is claimed is:

1. In a tilt-in space wheelchair, said wheelchair comprising in combination a frame and associated seating means attached thereto, two opposed operating wheels rotationally mounted on said frame, a foot support mounted on said frame, a pair of sleeves fixedly mounted in a substantially vertical orientation to a forward end of said frame, and two opposed casters having posts swivelly mounted to said pair of sleeves and wheels rotatable mounted to lower ends of said posts, the improvement comprising:

two laterally opposed four bar linkages, each four bar linkage including a first bar in the form of a first plate fixedly attached to a respective sleeve, a second bar having a forward end pivotally connected to said first plate and a rearward end pivotally connected to a third bar through selective adjustable locking means, said third bar being a second plate fixedly connected to said frame, and a fourth bar having a forward end pivotally connected to said first bar and a rearward end pivotally connected to said third bar, said adjustable locking means being configured for permitting said frame and said associated seating means to tilt by pivoting about an angular range of approximately 45 degrees in finite steps of selectable locked positions of adjustment relative to said second bar; wherein said bars are selected in length such that said pair of sleeves are maintained in said substantially vertical orientation as said frame and said associated seating means tilts.

2. The wheelchair of claim 1 wherein said frame and associated seating means are collapsible.

3. The wheelchair of claim 1 wherein said adjustable locking means comprises:

a cam-activated gear lock mechanism comprising:

an indexable arm fixed to a shaft rotatable in a place there being fixed to said plate both a first face-gear/clutch half and a first cylindrical cam half concentric with said first face-gear/clutch half, a second cylindrical cam half complimentarily mating with said first cylindrical cam half and rotatably and slideably located relative said shaft, means to selectively rotate said second cylindrical cam half, a second face-gear/clutch half slideably disposed on said shaft and rotationally fixed relative thereto, said first and second face-gear/clutch halves meshable one with the other, a throwout plate fastened to said second face-gear/clutch half and bearing on said second cylindrical cam half, and a compression spring concentric to said shaft, a proximal end of said spring thereof biasing said second face-gear/clutch half toward said first face-gear/clutch half and said second cylindrical cam half toward said first cylindrical cam half, a distal end of said spring being axially constrained by means associated with said shaft; whereby there is provided an adjustable, selectively-lockable, angular tilt of said wheelchair.

4. The wheelchair of claim 3 wherein the first and second face-gear/clutch halves have teeth with sharp arrises.

* * * * *